US010170231B2

(12) United States Patent
Winkler et al.

(10) Patent No.: US 10,170,231 B2
(45) Date of Patent: Jan. 1, 2019

(54) CHOKE AND CHOKE CORE

(71) Applicant: SUMIDA Components & Modules GmbH, Obernzell (DE)

(72) Inventors: Johann Winkler, Hutthurm (DE); Ernst Holzinger, Tettenweis (DE); Robert Ludwig, Pocking (DE); Iyad Kebaisy, Passau (DE); Herbert Jungwirth, Hauzenberg (DE)

(73) Assignee: Sumida Components & Modules GmbH, Obernzell (DE)

( * ) Notice: Subject to any disclaimer, the term of this patent is extended or adjusted under 35 U.S.C. 154(b) by 251 days.

(21) Appl. No.: 14/674,424

(22) Filed: Mar. 31, 2015

(65) Prior Publication Data

US 2015/0287512 A1 Oct. 8, 2015

(30) Foreign Application Priority Data

Apr. 3, 2014 (DE) ..... 10 2014 206 469

(51) Int. Cl.
*H01F 27/24* (2006.01)
*H01F 27/28* (2006.01)
*H01F 37/00* (2006.01)

(52) U.S. Cl.
CPC ..... *H01F 27/24* (2013.01); *H01F 27/28* (2013.01); *H01F 37/00* (2013.01)

(58) Field of Classification Search
CPC ..... H01F 27/00–27/36
USPC ..... 336/180–184, 212, 178, 220–223, 200, 336/232–234
See application file for complete search history.

(56) References Cited

U.S. PATENT DOCUMENTS 4,711,019 A 12/1987 Albeck et al. ..... 29/606
5,555,494 A * 9/1996 Morris ..... H02M 3/337 363/132
5,760,671 A 6/1998 Lahr et al. ..... 336/200
(Continued)

FOREIGN PATENT DOCUMENTS

CN 1412792 4/2003
CN 101661825 3/2010
(Continued)

OTHER PUBLICATIONS

English translation of Notice of Grounds of Rejection in the corresponding Japanese application No. 2015-075913 dated Mar. 15, 2016, five (5) pages.
(Continued)

*Primary Examiner* — Tuyen Nguyen
(74) *Attorney, Agent, or Firm* — Fattibene and Fattibene LLC; Pual A. Fattibene

(57) ABSTRACT

The present invention relates to a choke with two coils and a core for interleaved applications in step-up or step-down circuits or power factor compensation circuits. The core comprises several core sections with several lateral legs and a middle leg, whereby the core is designed such, that a coupling factor k of the two coils is smaller than 3%-5%. Furthermore, the core is designed such, that the core section form two loops with the middle leg as a common section, whereby each of the two coils lies on different loops outside of the common section. The lateral legs have a cross section A1 and the middle leg for the common section has a cross section A2<2×A1.

12 Claims, 5 Drawing Sheets

(56) References Cited

U.S. PATENT DOCUMENTS

| | | | | |
|---|---|---|---|---|
| 6,362,986 | B1 | 3/2002 | Schultz et al. | 363/132 |
| 6,549,436 | B1 | 4/2003 | Sun | 363/44 |
| 6,737,951 | B1 | 5/2004 | Decristofaro et al. | 336/234 |
| 6,771,157 | B2 | 8/2004 | Nishikawa et al. | 336/178 |
| 6,980,077 | B1 * | 12/2005 | Chandrasekaran | H01F 27/255 336/212 |
| 8,031,042 | B2 | 10/2011 | Silva | 336/212 |
| 8,217,746 | B2 | 7/2012 | Kitajima et al. | 336/178 |
| 2002/0075118 | A1 * | 6/2002 | Klaassen | H01F 3/12 336/212 |
| 2008/0284550 | A1 * | 11/2008 | Shinmen | H01F 29/14 336/155 |
| 2009/0185398 | A1 * | 7/2009 | Cuk | H02M 1/34 363/21.1 |
| 2009/0231885 | A1 * | 9/2009 | Won | H01F 38/10 363/17 |
| 2015/0302981 | A1 * | 10/2015 | Kaneko | H01F 38/08 336/207 |

FOREIGN PATENT DOCUMENTS

| | | | |
|---|---|---|---|
| DE | 67370 | | 3/1939 |
| DE | 1638585 | | 10/1970 |
| DE | 6607921 | U | 5/1971 |
| DE | 28 03540 | | 8/1979 |
| DE | 3505976 | | 8/1986 |
| DE | 295 20 024 | U1 | 3/1996 |
| DE | 196 45 098 | A1 | 5/1998 |
| DE | 102 14 992 | A1 | 10/2003 |
| EP | 0 387 841 | B1 | 6/1993 |
| JP | H04-134810 | | 5/1992 |
| JP | H 04134810 | | 5/1992 |
| JP | H05-036821 | U | 5/1993 |
| JP | H 07183134 | | 7/1995 |
| JP | H08-162334 | | 6/1996 |
| JP | 2000150255 | A * | 5/2000 |
| JP | 2003-224012 | | 8/2003 |
| JP | 2010-263238 | | 11/2010 |
| WO | WO 93/11547 | | 6/1993 |

OTHER PUBLICATIONS

European Search Report in the corresponding EPO application No. 15 16 0023 dated Sep. 16, 2015, two pages.

English translation of German search report dated Jun. 29, 2014 in corresponding German Application No. 10 2014 206 439.4.

German search report dated Jun. 29, 2014 in corresponding German Application No. 10 2014 206 439.4.

Notification of the First Office Action in the corresponding Chinese application No. 20151023708X dated Aug. 3, 2016, seven (7) pages with English translation , ten (10) pages.

* cited by examiner

CHOKE AND CHOKE CORE

FIELD OF THE INVENTION

The present invention relates to a choke with two coils and one core, optimized to be used in step-up or step-down circuits or power factor compensation (PFC) filters in an interleaved configuration. Furthermore, the present invention relates to an optimized double coil core for interleaved applications in step-up and step-down or power factor compensation (PFC) circuits.

BACKGROUND OF THE INVENTION

In the following, the term "choke" relates to a configuration from one or several coils placed on a common core.

A step-up or step-down circuit refers to a circuit, which can increase or decrease a direct-current voltage. Step-up and Step-down circuits operate according to similar principles like power factor compensation filters and partially use the same components.

A power factor correction is imposed in Germany for electric loads over 75 watt since 1 Jan. 2001 by the electromagnetic compatibility norm (EMC). Power factor describes the rate between the value of the effective power and the apparent power. A value less than 1 means that the apparent power, which is drawn from the power grid, is larger than the effective power, so that the power grid is additionally loaded by the apparent power, which has to be provided and transported and which partially has to flow back through the power grids. Hereby greater losses occur in the grid and the grid has to be dimensioned larger than actually necessary. Power factor correction filters make sure that the power factor is as close as possible to 1, i.e. only pure effective power is drawn from the power grid. In an active power factor correction (PFC) the drawn current is readjusted to the time dependent sinus shape voltage of the power grid.

A central component of step-up, step-down circuits and of PFC is a choke, which is in principle used to temporarily store Energy and release it on requirement. The following explanations confine on the use of the choke in PFC filters. However, similar reasoning is also true for step-up and step-down circuits.

A switch connected downstream of the choke which can adjust the coil output to a reference potential, is opened and closed by a controlling device so as on the one hand to deliver sufficient power to an electric load, but on the other hand so that the current of the grid voltage curve drawn from the grid is in-phase.

In a further development the input power voltage is divided between two coils which can be operated independently from one another. In general the switches are operated inverse to one another, i.e. if one switch is opened, the other switch is closed. In such an "interleaved" operational mode a choke branch (master) is directly controlled by the regulation circuit, i.e. the switching times for the choke are directly controlled by the regulation. The second choke branch (slave) generally follows the master with a phase shift of 180 degrees. Such an interleaved working arrangement has the advantage, that a more efficient power factor correction can be achieved. Since each choke has to cope with only half of the output power, smaller components can be dimensioned, so as to improve the power loss and heat generation and allow for smaller PFC-circuits. It is to be noted, that a correct functioning is possible also at other phase shifts <180°. That is, in general, the phasing can be variable. However, the majority of applications operate with a phase shift of 180°.

Active PFC circuits usually consist of a rectifier with a step-up convertor directly attached downstream with a coil and a switch, which charges a large capacitor to a voltage above the peak voltage of the grid network alternating current. FIG. 1A schematically shows the principles of a step-up circuit in interleaved technology. At the input the input voltage $V_{IN}$ is applied to the two choke coils L1 and L2 and the input current $I_{IN}$ is divided between the two chokes. At the output of each coil or choke L1 or L2 a switch S1 or S2, respectively, can set the output L1 or L2 controlled by a regulation circuit (not shown) to a reference potential. The outputs of coils L1 and L2 are connected through a diode to the capacitor $C_{OUT}$, which, in interaction with the coils L1 and L2 increases the voltage (step-up circuit) and smoothes the voltage, so that it can be delivered to the load resistance $R_{LOAD}$.

The opening and closing times of switch S1 are set by a controller (master), which ensures that on the one hand the load $R_{LOAD}$ is provided with sufficient current $I_{OUT}$ and on the other hand the input voltage $I_{IN}$ is following in-phase the input voltage $V_{IN}$. The switch S1 follows the switch S1 phase shifted by 180 degrees (slave). This causes in principle a pulse width modulation of the input current, in which the pulse width is controlled by a controller. FIG. 1B shows the switching characteristics of the switches S1 and S2. The time in which switch S1 is closed is denoted as $T_{on}$ and is variable according to the controller. In the time in which switch S1 is closed, switch S2 is opened (180 degree phase shifted). The overall time, which consists from the sum of the time $T_{on}$, in which the switch S1 is closed and the time $T_{off}$, in which the switch is opened, is denoted as period T and is constant. The duty cycle $D=T_{on}/T$ is variable and dependent on the controller. In FIG. 1*b* a constant duty cycle D of 0.5 is shown.

FIG. 1C shows the currents I1 and I2 through the coils L1 and L2. The current I1 through coil L1 consists from a direct current component Idc1 and a ripple component Iac1, generated by the switching processes. Accordingly, the current I2 through the coil L2 consists from a direct current component Idc2 and a ripple component Iac2 (alternating current component caused by switching processes). Since the switches are connected with a phase shift by 180 degrees, the phase shift between Iac1 and Iac2 is 180 degrees. On the capacitor $C_{OUT}$ the currents I1 and I2 are added. I.e. the complete direct current component results in Idc=Idc1+Idc2. From Idc1=Idc2=$I_{IN}/2$ follows for Idc that Idc=$I_{IN}$. For the complete ripple current component (alternating current component) follows Iac=Iac1−Iac2, since Iac1 and Iac2 are phase shifted by 180 degrees. This, however, is only true for a duty cycle of D=0.5, i.e. for $t_{on}=t_{off}$. I.e. for a duty cycle of D=0.5 the ripple current components mutually compensate. At different duty cycles the ripple current components do not precisely compensate each other. In any case, on the whole, in the interleaved design the ripple current component is reduced giving a smoother current curve.

It should be noted, that at a phase shift of 180° the ripple current maximum in the middle leg is reached at a duty cycle of D=0.5. The interleaved choke, however, also functions at other phasings <180°. Hereby only the duty cycle D, at which the maximum of the alternating current ripple occurs, is shifted. I.e. that in general the phasing can be variable. However, the majority of applications operates at a phase shift of 180°.

Chokes for use in interleaved step-up circuits and PFC steps are known from state of the art. In the simplest case two coils are wound on a common core, like for example shown in U.S. Pat. No. 6,362,986 B1 of the Volterra company. FIG. 2 schematically shows the coil arrangement of this patent with switches 40 for the interleaved operation mode. The two coils 20 and 30 are arranged on a common ring-shaped core 10, i.e. the pair of coils 20, 30 works with a strong magnetic coupling, similar to a transformer. Since the magnetic flows from the coils sum up, the core geometries are correspondingly large, so as to reach a high magnetic conductivity and at the same time not to stress the core up to the saturation magnetization.

U.S. Pat. No. 8,217,746 B2 describes a further development of a choke coil for interleaved PVC circuits, in which the coil core for the two coils is designed such that the two coils are only weakly magnetically coupled. FIG. 3 shows a schematic view of the coil- and core configuration of U.S. Pat. No. 8,217,746 B2. The core consists from two E-shaped parts 110 and 120, which are separated from one another by an I-shaped part 130. The coils 20 and 30 are wound on the middle legs of the E-shaped parts 110 and 120. Since the magnetic flows Φ1 and Φ2 in the coils 20 and 30 from the middle legs of the E-shaped parts divides between the lateral legs of the E-shaped parts, the cross section A2 of the lateral legs can be half the size of the cross section A1 of the middle legs. Since the coils 20 and 30 are wound or connected in phase opposition, the direct current components of the magnetic flows Φ1 or. Φ2 of the coils 20 and 30 in the I-shaped portion of part 130 extent compensate one another to a large, so that the cross section of the I-shaped part 130 can be designed smaller than the cross section A1 of the middle legs of the E-shaped parts 110 and 120. By connecting the two E-shaped parts 110 and 120 and of the I-shaped part 130 air gaps 140 are formed at the joints.

SUMMARY OF THE INVENTION

In view of new power safe technologies, such as in automotive engineering in the domain of hybrid and electro vehicles there is a growing demand for chokes for interleaved PFC circuits with low weight and high efficiency so as to safe energy on the one hand (weight) and at the other hand to efficiently transport energy, for instance, if motion energy in electric or hybrid vehicles is retrieved with a generator and supplied into the on-board electrical grid. It is therefore a task of the present invention to provide a choke with an optimized core geometry for a choke coil pair for use in interleaved PFC-application, which is compact and has small losses and a low weight.

The task is solved with a choke with two coils and one core according to the present invention.

In particular this task is solved by a choke with two coils and one core, wherein the core contains several core section with several lateral legs and one middle leg, wherein the core is designed such, that the core section form two loops with the middle leg as a common section, wherein each of the two coils lies on different loops outside of the common section, so that the lateral legs have a cross section A1, and that the middle leg for the common section has a cross section A2<2×A1.

With this arrangement a coupling factor k of the two coils smaller than 5%, preferably smaller than 3%, and more preferably smaller than 1% is realizable, so that the core cross section can be kept small in the lateral legs, since the magnetic fields of the coils no longer overlap in the lateral legs. Furthermore, the magnetic flux, which corresponds to the direct current component, compensates in the common section, so that the cross section of the common section can be designed small so as to save material. Since the coils are not arranged coaxially like in U.S. Pat. No. 8,217,746 B2, but rather are placed on the lateral legs, less material is required for the core, which saves weight. This is for instance reached by arranging the two coils on two opposing lateral legs.

In another embodiment the cross section A1 lies in a range between 0.5 A1 and 0.2 A1, so that more weight can be saved.

In order to reach a coupling factor of less than 5%, 3% or 1%, the core is designed such, that the magnetic resistance in at least one of the lateral legs $R_{MA}$ is larger than the magnetic resistance of the middle leg $R_{MI}$, wherein $R_{MA}>20\ R_{MI}$ (5%), $R_{MA}>33\ R_{MI}$ (3%) or $R_{MA}>100\ R_{MI}$ (1%).

In another embodiment, for the core section in the middle section a material with a high permeability is used to keep the coupling between the two windings or their flows low. In the lateral legs a material with a high saturation flow density is preferably used so as to keep the magnetic cross section of the lateral legs low.

This embodiment with different materials for lateral legs and middle legs is only advantageous in specific cases, in which a too strong coupling between the two windings and high losses should be avoided. A high permeability is not necessary in general, since the core is sheared. Common power ferrites which can be used generally have an initial permeability μi between 1000 and 3000. A high permeability in the middle leg is advantageous since it reduces the coupling. The influence of the permeability of the lateral legs on the coupling is negligible, since the air gap dominates the magnetic resistance. For this reason rather a highly permeable magnetic material is used in the middle leg. Since losses dominate due to the increased exchange flow duty cycle caused by the reduction of the cross section, the cross section of the middle leg cannot be reduced up to the saturation limit, so that in this case preferably a material with lower losses having a slightly lower saturation flow density is used. In the lateral leg a material with a high duty cycle is used—like in a regular choke. In most applications the entire core can consist of one material. Only in specific cases (too high coupling, high losses in the middle leg) one will use different materials for the lateral legs and the middle leg.

In order to reach a 100 fold increased magnetic resistance in one of the lateral legs as compared to the middle leg, in one embodiment the lateral leg can feature an air gap, which is preferably arranged in the areas of the coils.

In order to reach the core geometry according to this invention, different embodiments are possible.

In one embodiment the core section are formed by two E-shaped parts, which are combined, such that their free ends meet, so that the connected middle legs of the two E-shaped parts form the common section. With this configuration a shorter and thus more compact design than for instance shown in U.S. Pat. No. 8,217,746 is possible.

In another embodiment the lateral legs are formed by two U-shaped parts, which are connected such, that their free ends meet, creating a magnetic circuit, whereby the middle leg for the common section has a T-shape and is inserted such between the two coils into the magnetic circuit, that the magnetic circuit is short-circuited, so that the magnetic circuit is divided into the two magnetically weakly coupled loops. Besides the compact design this embodiment has the advantage, that when connecting the two formed components, only two surfaces meet, contrarily to the E-shaped forming component, in which three surfaces meet. If three surfaces meet the formed components have to be manufactured with a very high precision so as to avoid uncontrolled air gaps. Due to manufacturing tolerances these air gaps are virtually unavoidable. If two surfaces meet like for the U-shaped components and the T-shaped component, this effect does not occur, so that with this embodiment chokes with lower tolerances can be manufactured.

In one of its embodiments the height H2 of a vertical part of the T-shaped middle leg corresponds to a height H1 of the lateral leg. Furthermore, a width B2 of the vertical part of the T-shaped middle leg corresponds to a clear distance between the two coils and a depth T2 of the vertical part of the T-shaped core section corresponds to an inner distance T1 of the opposite lateral legs of the magnetic circuit. This contributes to a compact design, since the space between the coils within the magnetic circuit is filled free of clearance and is, thus, completely usable for the magnetic flow. In a further embodiment, a horizontal part of the T-shaped middle leg is supported by a lateral leg. Overall, the T-shaped design of the middle leg allows a simple and precise positioning of the magnetic short-circuit between the two coils. By the supporting surfaces, formed by the horizontal parts of the T-shaped middle leg, the middle leg is precisely inserted up to the correct depth into the magnetic circuit.

In a further embodiment the lateral legs are formed by two U-shaped parts, whose free ends oppose each other and are separated without play from one another by a straight elongated core section, which serves as a middle leg, so that the two legs are formed with the middle leg as a common section, which form two jointly weakly coupled magnetic circuits. A straight elongated core section, which serves as middle leg, has in comparison to a T-shaped core section the advantage, that micro air gaps created between the T-part and the lateral legs are avoided. Hereby the coupling between the magnetic circuits is reduced. At the same time this arrangement can compensate for the tolerance in the lateral air gaps or lateral legs, respectively, since the middle leg can now be flexibly glued to the lateral legs or side plates. Small excess ends of the middle leg are of no problem, but also a slightly shorter middle leg only insignificantly influences the current flow. In one embodiment each U-shaped part or E-shaped part is composed from several straight parts. These straight parts can be, for example, glued, so that tolerances due to uncontrolled micro air gaps are reduced.

In an embodiment the core sections are manufactured from a plate stack from a magnetically soft material. With this technique arbitrary core shapes can be realized with little technical effort.

The above-mentioned task can also be solved with a choke core, which comprises several core sections consisting from several lateral legs and a middle leg. Hereby the core sections are arranged such, that the core section form two loops with the middle leg as a common section, so as to form two weakly coupled magnetic circuits, whereby the lateral legs have a cross section A1 and whereby the middle leg for the common section has a cross section A2 smaller than 2×A1.

BRIEF DESCRIPTION OF THE DRAWINGS

In the following, exemplary embodiments, modification, advantages and application examples of the invention using the enclosed figure are described. Hereby all described and/or depicted features alone or in any combination are in general subject matter of the invention, independent of their summary in the claims or their back reference. Also the content of the claims is made part of the description. It is shown in the figures:

DETAILED DESCRIPTION OF THE PREFERRED EMBODIMENTS

The present invention was made to provide chokes with an optimized compact core geometry for PFC-devices with interleaved-topology. Especially in growing electromobility, technology with electric vehicles (EV) and hybrid electric vehicles (HEV), new, compact, i.e. having low weight, chokes and choke cores are needed, which can be used at frequencies above 100 kHz.

Figure 1A:
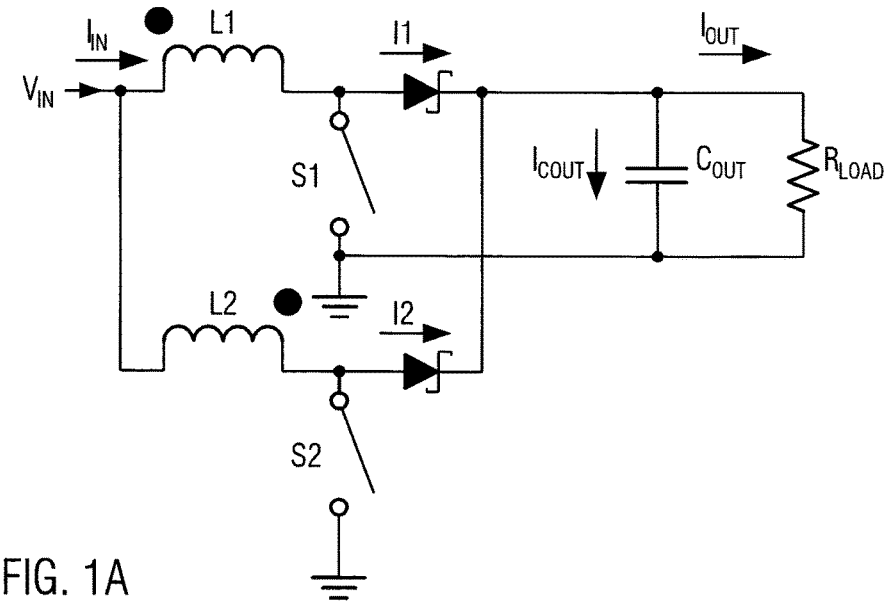
FIG. 1A (Prior Art)
FIGS. 1A-C the principle of a step-up convertor in interleaved-technology.
Figure 1B:
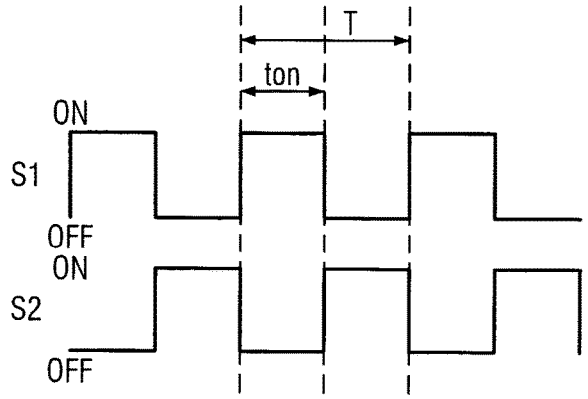
FIG. 1B (Prior Art)
Figure 1C:
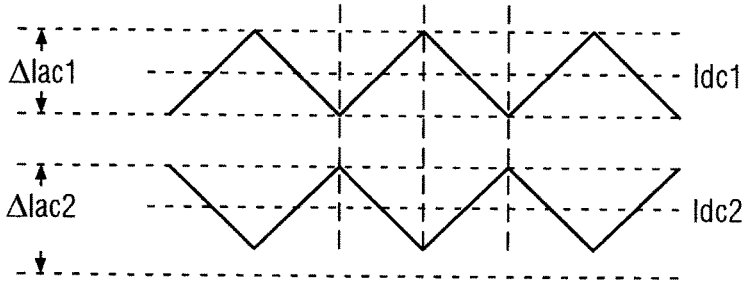
FIG. 1C (Prior Art)
Figure 2:
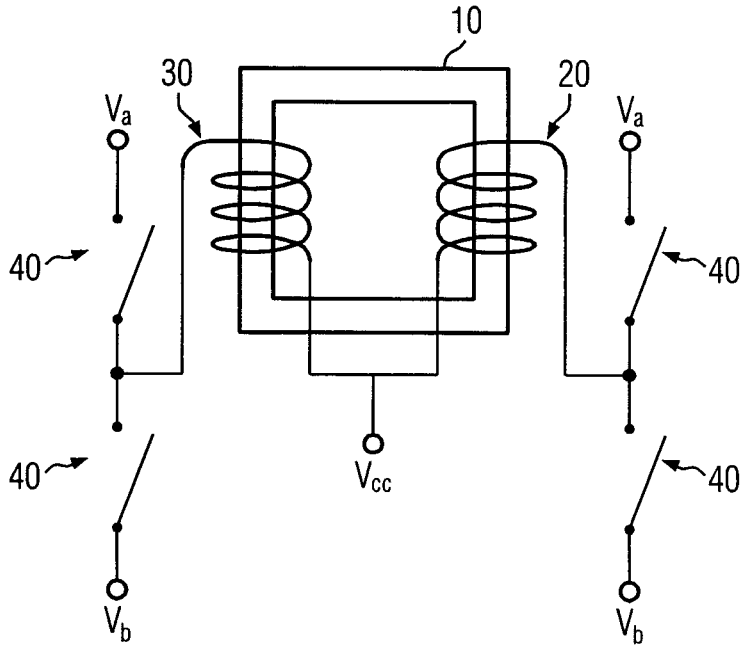
FIG. 2 (Prior Art)
FIG. 2 a first example for a choke for use in a PFC-device according to state of the art.
Figure 3:
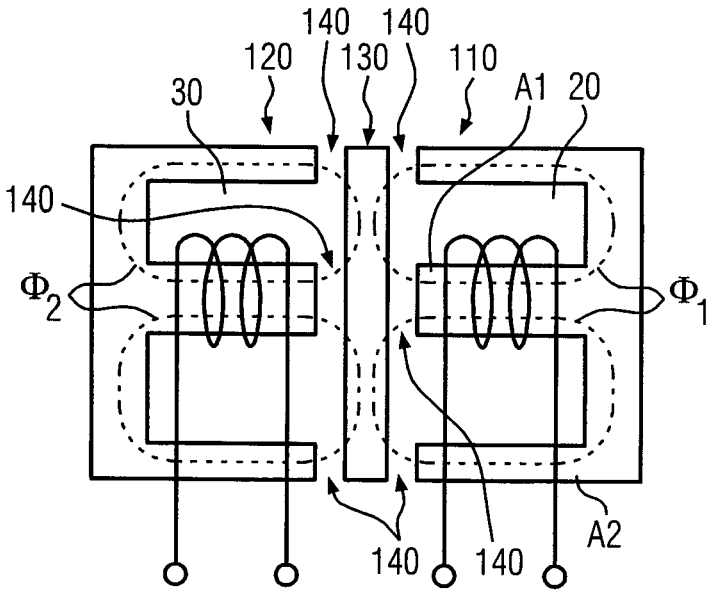
FIG. 3 (Prior Art)
FIG. 3 a second example for a choke for use in a PFC-device according to state of the art.
Figure 4:
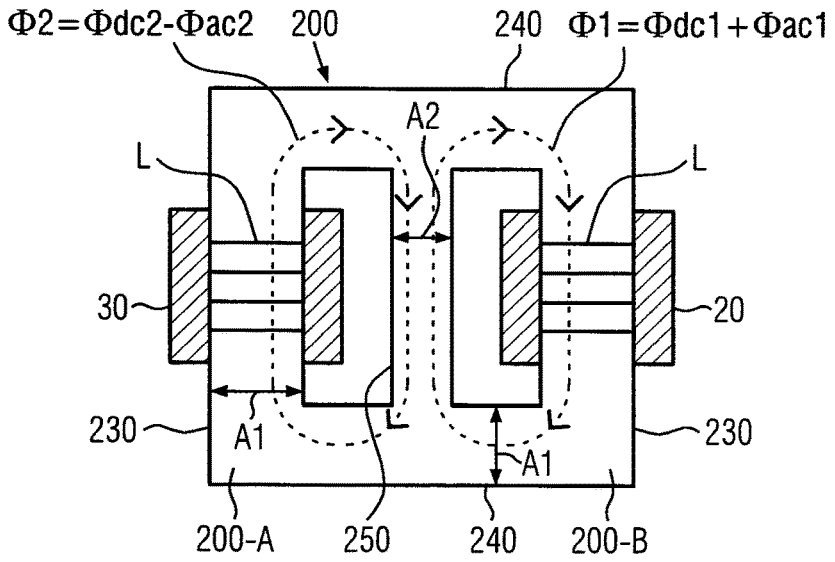
FIG. 4 the principle of a choke for PFC-devices according to the present invention.

FIG. 4 shows the principle of the present invention. Two coils 20 and 30 are placed on an optimized compact core 200, which consists from several lateral legs 230 and 240 with a middle leg 250. The lateral legs consist from two lateral legs 230 with coils and two lateral legs 240, which serve as connection elements for the lateral legs 230 carrying the coils that form a magnetic circuit. The middle leg 250, which runs in parallel to the coils carrying lateral legs 230, and which connects approximately the middles of the lateral legs 240, causes a magnetic short-circuit between the connection elements 240 and divides the magnetic circuit in two loops 200-A and 200-B. The lateral legs have a cross section A1. The middle leg has a cross section A2 which is smaller than 2×A1. In the PFC-application the coils 20 and 30 are connected such that the direct current component of the magnetic flux in the middle leg 250 runs in opposite direction and thus compensates itself. Thanks to the compensated DC-flow (direct current) the cross section of the middle leg can be significantly reduced. However, the alternating current of the coils 20 and 30 in general adds in the middle leg, since the alternating current amplitudes sum up in the middle leg due to the inversed poling of the coils 20 and 30. At a duty cycle of D=0.5, i.e. $T_{on}=T_{off}$, the maximal alternating current is FiAC max=Φac1 (alternating current through coil 20)+Φac2 (alternating current through the coil 30). At other duty cycles the maximal alternating current amplitude through the middle leg 250 is reduced. If the lateral legs 230 and 240 are operated up to a saturation current density $B_{satt}$ of common ferrite materials of 350-400 mT, the relation between the ripple current Iac and the total current Iac+Idc is adjusted to a value between 0.1 and 0.5, the minimal cross section A2 of the middle leg 240 can become 0.2 to 1 fold of the cross section A1 of the lateral legs. Preferably, the PFC-steps are adjusted such, that A1 is in the range between 1×A1 to 0.2×A1.

In order to reach a coupling between the coils 20 and 30, the magnetic resistance $R_{MA}$ in the lateral legs should be 100 times the magnetic resistance $R_{MI}$ in the middle leg. The coupling factor results from $k=R_{MI}/R_{MA}$, wherein $R_{MI}$ is the magnetic resistance in in the middle leg and $R_{MA}$ is the magnetic resistance in the lateral legs. Despite a small cross section A2 of the middle leg 250 this is reached through the air gaps L, which can be, for example, incorporated into the lateral legs 230 in the area of the coils 20 and 30, so as to avoid that a relatively large direct current portion through the coils makes the core in the lateral legs reach saturation. Through the small magnetic coupling the magnetic fields of the coil 20 do not penetrate into the core section of the lateral legs of the coil 30 and inversely, as it would be the case for a strong coupling. For a strong magnetic coupling the magnetic fields of the coils would at least partially enhance each other, so that the saturation magnetization in the lateral legs would be reached faster, i.e. for a strong magnetic coupling of the coils 20 and 30 the cross section of the lateral legs would have to be dimensioned larger. However, in general it is advantageous to use materials with a low magnetic resistance (high permeability) in the middle leg and a high saturation magnetization in the lateral leg.

Figure 5:
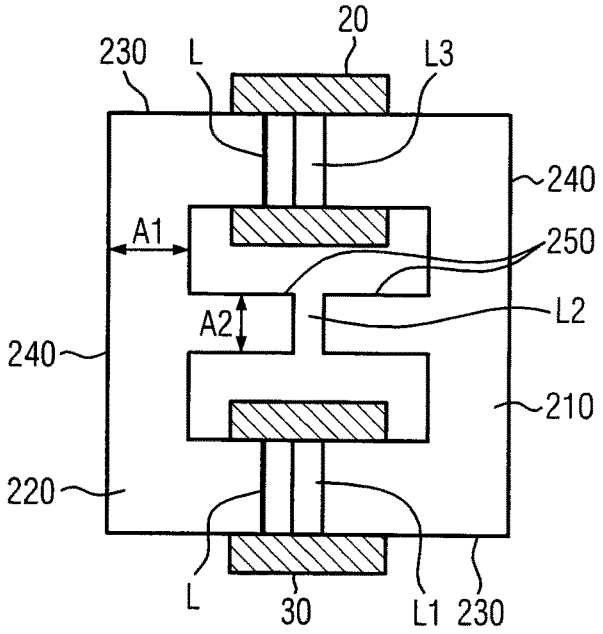
FIG. 5 a first embodiment of a choke for PFC-devices according to the present invention.

FIG. 5 shows an implementation of the present invention according to a first embodiment with two E-shaped formed components 210 and 220, which are connected such that their free ends meet. To illustrate the E-shape in FIG. 5 larger gaps L1, L2 and L3 between the free ends of the two E-shaped parts 210 and 220 are shown. When implementing, as far as possible, no gaps L1, L2 and L3 should occur in order to avoid undefined air gaps, i.e. the ending surfaces on the free ends of the E-shaped parts have to be manufactured so precisely, that they lie in one plane, so that no air gaps occur. Air gaps are exemplarily selectively introduced in the lateral legs 230 in the area of the coils 20 and 30. The cross section A2 of the middle leg 250 is, as explained in detail above, smaller than the cross section A1 of the lateral legs 240 and 230.

In order to avoid a situation, as it can occur with E-shaped parts with the three gaps L1, L2 and L3, two U-shaped core parts 260 and 270 can be used, which are connected such, that their free ends meet.

Figure 6A:
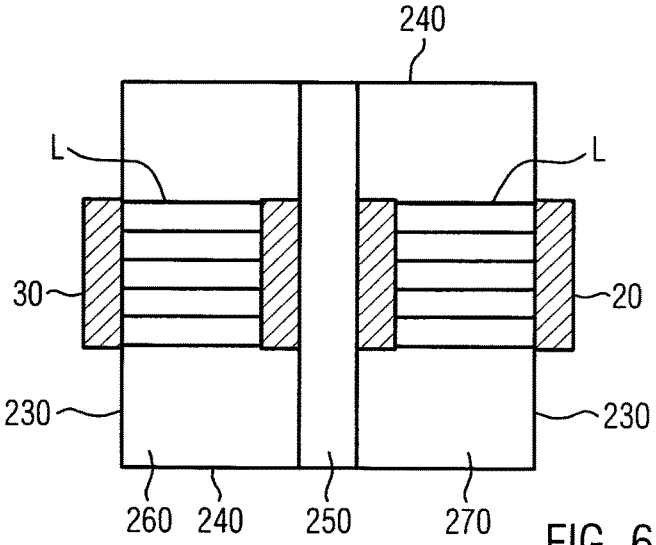
FIG. 6A a top-view of a second and third embodiment of a choke for PFC-devices according to the present invention.

FIG. 6A shows a schematic top view of a core from two U-shaped parts 260 and 270 with a middle leg 250 according to a second and third embodiment of the present invention. In FIG. 6A the meeting edges of the free ends of the U-parts 260 or 270 are not visible. The coils 20 and 30 are positioned on the coils carrying lateral legs 230 of the core. The middle leg 250 fills the gap between the coils 20 and 30 and also forms a magnetic short-circuit between the lateral legs 240, so that two magnetic loops are formed. The air gap L in the lateral legs 230 in the area of the coils 20 and 30 leads to an operation outside of the magnetic saturation in the lateral legs and, at the same time, to a lower coupling of less than one percent between the two loops, respectively loops 20 and 30.

Figure 6B:
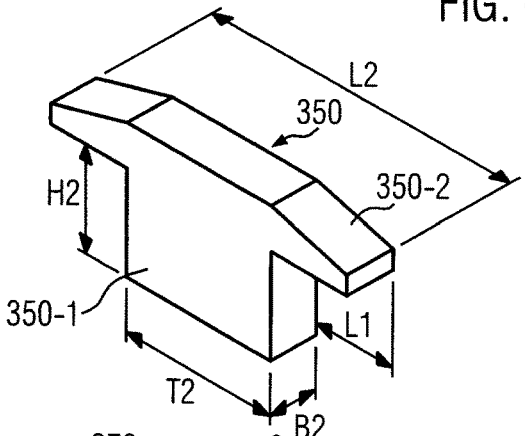
FIG. 6B a perspective view of a second embodiment of the choke according to the present invention.
Figure 6B:
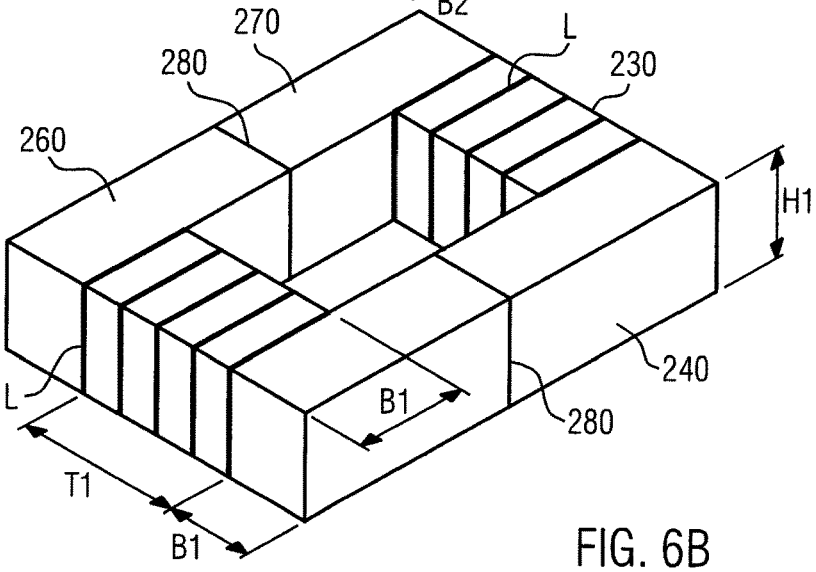

FIG. 6B shows a perspective view of the scheme of FIG. 6A according to a second embodiment with an extracted middle leg 350. FIG. 6B shows only the core arrangement without the coil windings 20 and 30 according to the second embodiment. The core is composed of two U-shaped parts 260 and 270, which meet at the face surfaces of the free ends of the U-shaped parts, as shown by line 280 in FIG. 6B. Since there are only two face surfaces 280, it is easier to avoid uncontrolled air gaps in the lateral legs. The lateral legs have a cross section of A1=B1×H1. The distance of the lateral legs 240, which connect the coils-wearing lateral legs 230 is T1. The middle leg 350, which is extracted in the illustration of FIG. 6B from the ring structure, is designed in a T-shape with a vertical part 350-1 and a horizontal part 350-2. The vertical part 350-1 has a height H2, a length T2 and a width B2. In order to optimally fill the air space between coils 20 and 30 (see FIG. 6A), the width B2 of the vertical part of the T-shaped middle leg 350 corresponds to the clear distance of the space in-between the coils. The length T2 of the T-shaped middle leg 350 corresponds to the distance T1 between the lateral legs 240 and the height H2 of the vertical part of the T-shaped middle leg 350 corresponds to the height H1 of the lateral legs 230 and 240. The excess ends of the horizontal part 350-2 of the T-shaped middle leg 350 have a length L1 and are supported by the lateral legs 240. The maximal length L2 of the horizontal part 350-2 of the T-shaped middle leg 350 is maximally T1+2×B1, or the length L1 of the excess ends of the excess part 350-2, supported by the lateral legs 240, are about B1. The air gaps L in the U-shaped parts 260 or 270 can be realized through filling materials like CEM1 or FR4. The thickness B2 of the T-shaped middle leg 350 is smaller than the width B1 of the lateral legs 230 and 240.

Figure 6C:
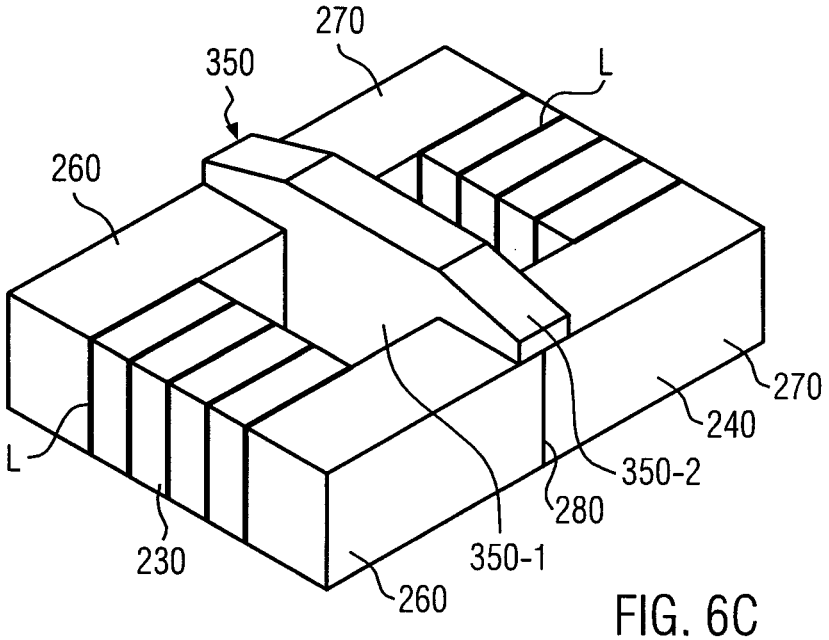
FIG. 6C another perspective view of the second embodiment of the choke according to the present invention.

FIG. 6C shows a perspective view of the core according to FIG. 6B in composite form. The reference signs in FIG. 6C, which are identical to the reference signs in FIG. 6B, denote the same technical features so that the explanations are not repeated at this place. The air gaps between the vertical part 350-1 of the middle leg 350 and the coil-carrying lateral legs 230 (the coils are not shown in FIG. 6C) are almost completely filled by the windings of the coils. In FIG. 6C the horizontal part 350-2 of the T-shaped middle leg 350 is flush with the lateral edges of the lateral legs 240. However, small deviations, i.e. excess ends and shorter ends do not affect the magnetic behavior of the whole core.

Figure 6D:
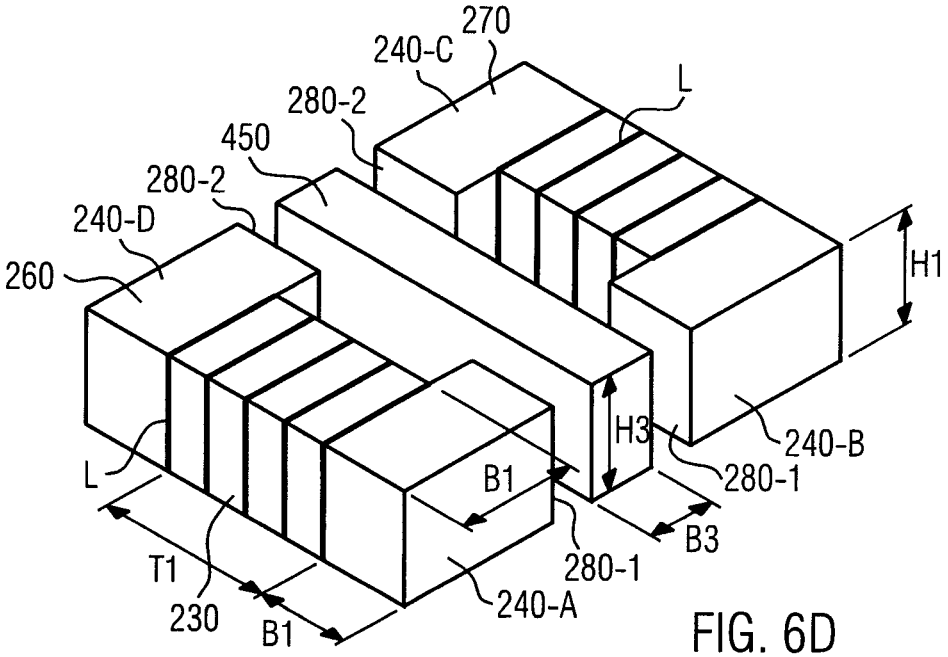
FIG. 6D a perspective view of a third embodiment of the choke for PFC-devices according to the present invention

FIG. 6D shows a perspective view of a core according to a third embodiment of the present invention. The core is composed like in FIG. 6D from two U-shaped parts 260 and 270. Between the U-shaped parts 260 and 270 a middle leg 450 is positioned, so that the free surfaces 280-1 and 280-2 of the opened ends of the U-shaped parts 260 and 270 meet with the opposite sides of the middle leg 450, which is rectangular-shaped with a height H3, width B3 and a length of T1+2 B1. The size indications T1, B1, and H1 correspond to the size indications in FIG. 6B. Otherwise, the U-shaped parts in FIG. 6B can be identical with the U-shaped part in FIG. 6D. In FIG. 6D reference signs, which are identical to those in the previous figures, denote the same technical features so that a repetition is waived here. FIG. 6D shows a schematic three-dimensional arrangement in which the single elements 260, 270 and 450 are shown pulled apart. In the assembled state the middle leg 450 is flexibly glued to the lateral legs 240-A, 240-B, 240-C and 240-D, which can compensate for the tolerances in the lateral air gaps L. Small excess ends of the middle leg or slightly shorter middle legs only insignificantly influence the current flow from the lateral legs in the middle legs.

What is claimed is:

1. A choke with two coils and a core in an interleaved circuit connected to a common signal source and having a first switch and a second switch, comprising:

a core having lateral legs with each of the lateral legs having a first magnetic reluctance or resistance and comprising a first material with a first cross section and a middle leg having a second magnetic reluctance or resistance comprising a second material with a second cross section, said core forming two loops with the middle leg as a common section;

a first coil placed around a first one of the lateral legs, said first coil coupled to the common signal source and the first switch;

a second coil placed around a second one of the lateral legs, said second coil coupled to the common signal source and the second switch;

wherein the second cross section of the middle leg is less than twice the first cross section of the lateral legs;

wherein the first and second materials are different and the second material of the middle leg has a higher magnetic permeability than a magnetic permeability of the first material of the lateral legs;

wherein the first magnetic reluctance or resistance of each of the lateral legs is at least twenty times greater than the second magnetic reluctance or resistance of the middle leg; and wherein the coupling factor of the first and second coils is less than five percent, whereby the choke and the interleaved circuit is capable of being made compact with small losses and low weight.

2. A choke with two coils and a core in an interleaved circuit connected to a common signal source and having a first switch and a second switch, comprising:

a core having lateral legs with each of the lateral legs having a first magnetic reluctance or resistance and a first cross section and a middle leg having a second magnetic reluctance or resistance with a second cross section, said core forming two loops with the middle leg as a common section;

a first coil placed around a first one of the lateral legs, said first coil coupled to the common signal source and the first switch;

a second coil placed around a second one of the lateral legs, said second coil coupled to the common signal source and the second switch;

wherein the second cross section of the middle leg is less than twice the first cross section of the lateral legs;

wherein air gaps are incorporated into the lateral legs so that the first magnetic reluctance or resistance of each of the lateral legs is at least twenty times greater than the second magnetic reluctance or resistance of the middle leg; and wherein the coupling factor of the first and second coils is less than five percent, whereby the choke and the interleaved circuit is capable of being made compact with small losses and low weight.

3. Choke according to claim 2, wherein the second cross section lies within a range from 1× the first cross section to 0.2× the first cross section.

4. Choke according to claim 2, wherein a magnetically highly permeable material is used for the middle leg and a material with a high saturation flux density is used for the lateral legs.

5. Choke according to claim 2, wherein the core is manufactured from a plate stack from a magnetically soft material.

6. Choke according to claim 2, wherein the core comprises two E-shaped parts, which are connected such, that their free ends meet, so that the connected middle legs of the two E-shaped parts form the common section.

7. Choke according to claim 2, wherein the lateral legs are formed by two U-shaped parts, which are connected such, that their free ends meet, so that a magnetic circuit is created, and wherein the middle leg for the common section has a T-shape and is inserted between the first and second coils such into the magnetic circuit, that the magnetic circuit is short-circuited, so that the magnetic circuit is divided into the first and second coils.

8. Choke according to claim 7, wherein in a height H2 of a vertical part of the T-shaped middle leg corresponds to a height H1 of the lateral leg, a width B2 of the vertical part of the T-shaped middle leg corresponds to a clear distance between the first and second coils and the length T2 of the vertical part of the T-shaped core section corresponds to an inner distance T1 of the opposing lateral legs of the magnetic circuit, so that the vertical section of the T-shaped core section fills the space free of clearance between the first and second coils within the inside the magnetic circuit.

9. Choke according to claim 7, wherein a horizontal part of the T-shaped middle leg lies on a lateral leg.

10. Choke according to claim 2, wherein the lateral legs are formed by two U-shaped parts, whose free ends mutually oppose each other are separated from one another without clearance by a straight elongated core section serving as the middle leg, so that the first and second coils with the middle leg are formed as common sections, forming two mutually coupled magnetic circuits.

11. Choke according claim 7, wherein each U-shaped part is assembled from several straight pieces.

12. Choke core for interleaved applications with several core sections consisting from several lateral legs and a middle leg, wherein the core sections are arranged such, that the core section form two loops with the middle legs as a common section to form two weakly coupled magnetic circuits, wherein the lateral legs have a cross section A1, wherein the middle leg has a cross section A2 smaller than 2×A1 for the common section, and wherein the magnetic resistance $R_{MA}$ of at least one of the lateral legs is larger than the magnetic resistance $R_{MI}$ of the middle leg, whereby $R_{MA}>20\times R_{MI}$.

* * * * *